US006651827B1

(12) United States Patent
Eberwein et al.

(10) Patent No.: US 6,651,827 B1
(45) Date of Patent: Nov. 25, 2003

(54) BROCHURE HOLDER

(75) Inventors: Brian T. Eberwein, Madison, WI (US); James A. Hofman, Stoughton, WI (US)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/704,884

(22) Filed: Nov. 2, 2000

(51) Int. Cl.[7] ..... A47F 7/00

(52) U.S. Cl. ..... 211/50; 211/51; 206/215; 206/449

(58) Field of Search ..... 211/51, 50, 55; 206/215, 449

(56) References Cited

U.S. PATENT DOCUMENTS

| | | | | |
|---|---|---|---|---|
| 12,604 | A | | 3/1855 | Palmer |
| 85,078 | A | | 12/1868 | Field |
| 101,130 | A | | 3/1870 | Hockett |
| 380,877 | A | | 4/1888 | Fellows |
| 701,655 | A | | 6/1902 | Widenhofer |
| 877,671 | A | * | 1/1908 | Simmons |
| 2,125,320 | A | | 8/1938 | Segar |
| 2,186,343 | A | | 1/1940 | Potts |
| D162,153 | S | | 2/1951 | Gilfert |
| 2,705,564 | A | | 4/1955 | Bray |
| 2,927,699 | A | * | 3/1960 | McGraw |
| 3,086,658 | A | | 4/1963 | Palmer |
| 3,942,682 | A | | 3/1976 | McKay |
| 4,242,817 | A | | 1/1981 | Ballard |
| 4,492,307 | A | * | 1/1985 | Hargrave |
| 4,585,128 | A | | 4/1986 | Hannecke |
| 4,588,093 | A | | 5/1986 | Field |
| 4,609,112 | A | * | 9/1986 | Belanger et al. ..... 211/50 X |
| 4,943,024 | A | | 7/1990 | Meyer |
| 5,002,249 | A | | 3/1991 | Meyer |
| 5,056,748 | A | | 10/1991 | Meyer |
| 5,094,349 | A | | 3/1992 | DeVito |
| 5,123,544 | A | * | 6/1992 | Hannecke ..... 211/51 |
| 5,150,813 | A | | 9/1992 | Harris et al. |
| 5,390,801 | A | | 2/1995 | Hansen |
| 5,484,064 | A | | 1/1996 | Melichar |
| 5,727,696 | A | | 3/1998 | Valiulis |
| 5,894,931 | A | * | 4/1999 | Dunn |
| 6,006,927 | A | * | 12/1999 | Levy ..... 211/51 |
| 6,213,313 | B1 | * | 4/2001 | Levy ..... 211/51 |

OTHER PUBLICATIONS

US 5,046,626, 9/1991, Hansen (withdrawn)

* cited by examiner

*Primary Examiner*—Robert W. Gibson, Jr.
(74) *Attorney, Agent, or Firm*—Marshall, Gerstein & Borun

(57) ABSTRACT

A display holder for displaying a stack of flexible material including a curved front wall extending from a base. A spring extends from a center portion of a rear wall to bias the stack of material toward the front wall and to impart a curvature in the stack of flexible material.

20 Claims, 4 Drawing Sheets

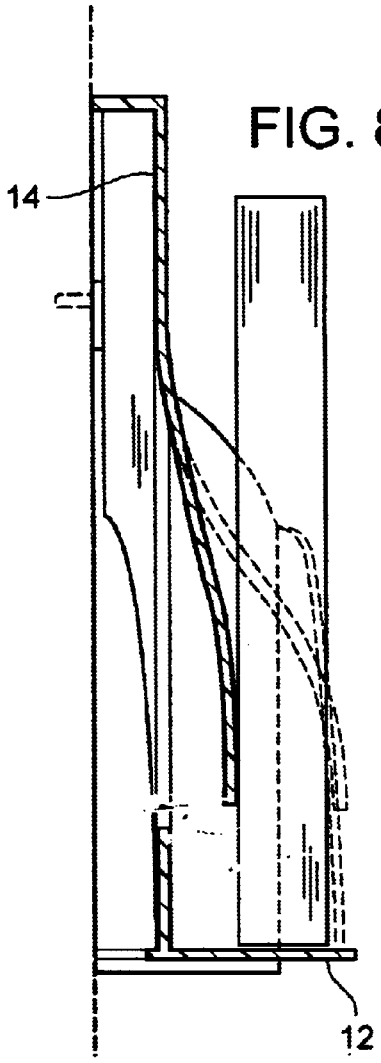
FIG. 8
FIG. 9
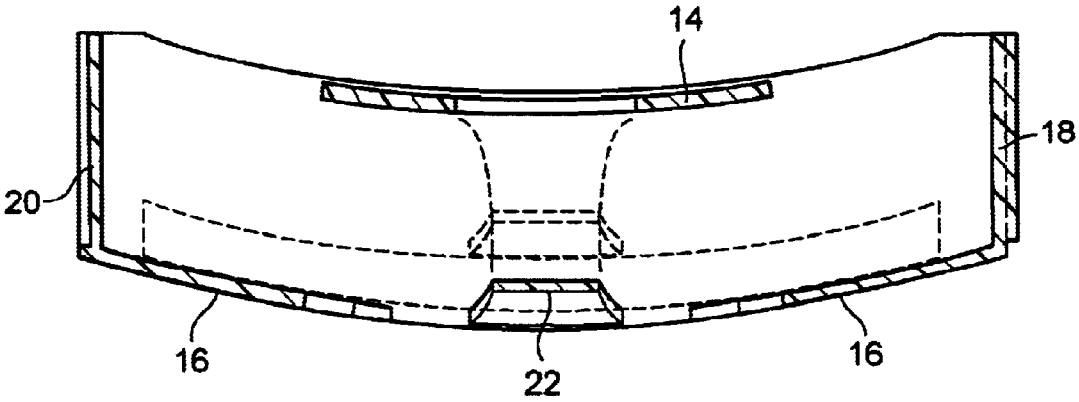

BROCHURE HOLDER

FIELD OF THE INVENTION

The present invention relates generally to a brochure holder and more particularly to a brochure holder having an integrally formed resilient spring member.

BACKGROUND OF THE INVENTION

Literature and brochure display holders for displaying brochures is well known in the art. Some brochure holders simply include a cavity in which the brochures are located. These type of holders work to hold the brochures in an upright position, so long as the cavity is filled with brochures. However, as the brochures are taken there is not sufficient support to maintain the brochures in an upright position. As a result the brochures may buckle and fold under their own weight. Additionally, the brochures may not be pressed up against the front face of the holder thereby making it more difficult for a user to access the brochures.

Some holders include a spring member to push the brochures against the front wall of the holder. U.S. Pat. No. Des. 162,153 discloses a separate spring device to push the stack of brochures against the front wall as the brochures are taken. However, this type of device requires a separate spring member requiring both additional space and complexity adding to increased material and assembly cost.

U.S. Pat. No. 4,943,024 discloses a clip biasing the printed material toward the back wall. The clip extends outwardly and upwardly from the lower edge of the back wall. This product pushes the printed material away from the user and covers the center portion of the printed material.

Another approach to supporting flexible documents requires imparting a curvature to the printed material to increase the rigidity of the document. U.S. Pat. No. 5,484,064 discloses a holder in which the distance between the side walls is less than the width of the documents to be supported. Since the width of between the side walls is less than the width of the documents to be held, the documents are forced to bow. The base is angled upward from the back wall. This device rubs against the edges of the printed documents thereby potentially damaging the printed material brochures. Further, the documents are not presented at the front of the holder.

U.S. Pat. No. 5,727,696 discloses a business card display holder that includes an integrally extruded spring member to push the business cards toward the front wall. This product however, does not impart a curve to the material stored and must be extruded thereby preventing integrally formed side walls.

Accordingly, it would be desirable to provide a brochure holder that that would both impart a curve to the brochures and bias the brochures toward the front wall of the brochure holder. Additionally, it would be desirable for the brochure holder to formed from a single integral component.

SUMMARY OF THE INVENTION

One embodiment relates to a brochure holder including a base, and a curved front wall extending from the base. A spring extends from rear wall toward the center of the curved front wall.

Another embodiment relates to a method for supporting a stack of flexible material in a holder. The stack of flexible material is supported along a base of the holder. A spring biases the stack of flexible material against a front wall portion and imparts curvature to the flexible material.

In another embodiment a display holder for displaying flexible sheet material includes a horizontal base and a rear wall extends from the horizontal base. The rear wall includes a first center opening having a top edge. A spring extends from the top edge and has a width less than the width of the center opening. A pair of side walls extends from the base and includes a lower portion and an upper portion. The upper portion is attached to the rear wall. The rear wall and lower portions of the side walls define a pair of second openings having a predetermined width. A pair of front wall portions extend from the base and from a respective side wall. Each front wall portion has a width less than the width the respective second opening.

BRIEF DESCRIPTION OF THE DRAWINGS

FIG. 8 is a cross-sectional view taken generally along lines 8—8 of FIG. 6.

FIG. 9 is a cross-sectional view taken generally along lines 9—9 of FIG. 4.

DETAILED DESCRIPTION OF THE PREFERRED EMBODIMENTS

Figure 1:
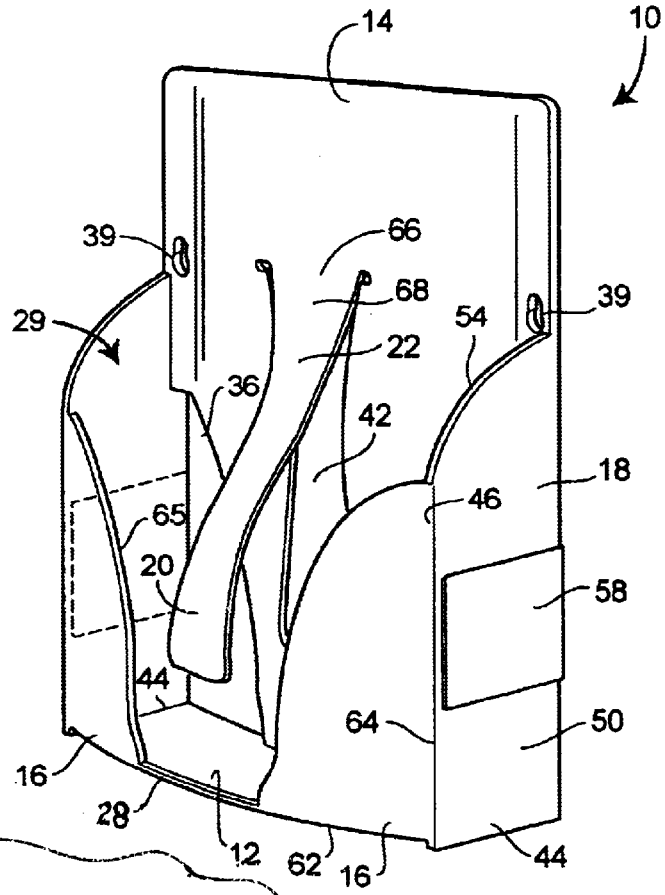
FIG. 1 is a perspective view of the brochure holder.

Referring to FIG. 1, a brochure holder 10 includes a base 12, a rear wall 14 extending from the base, a front wall 16 extending from the base, and a pair of side walls 18, 20 extending from base 12 and connected to both the rear wall 14 and the front wall 16.

Figure 2:
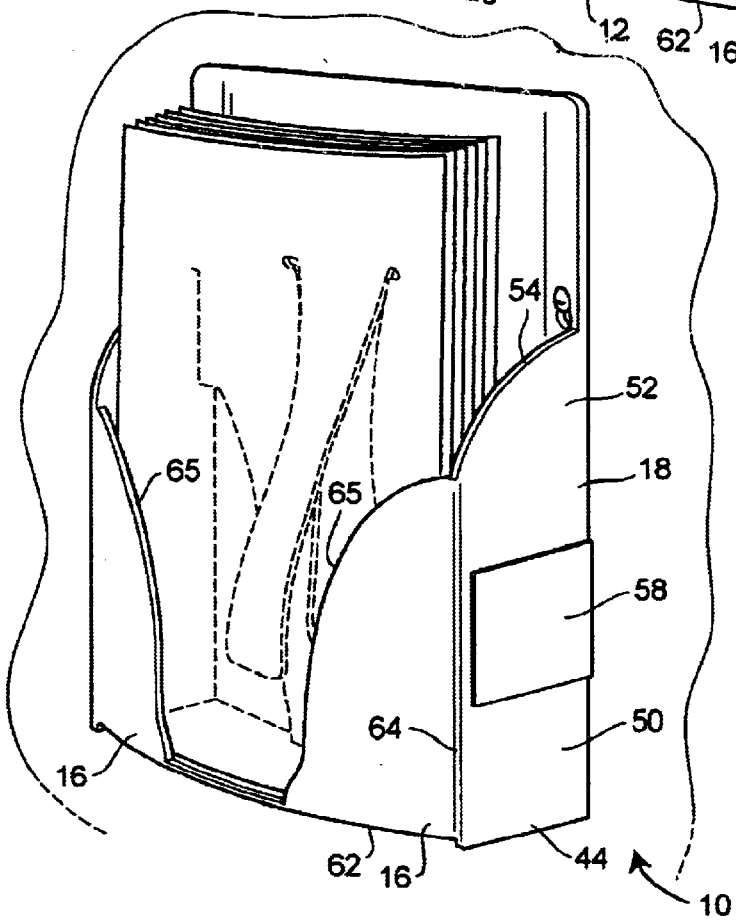
FIG. 2 is a perspective view of the brochure holder in a partially loaded position.
Figure 3:
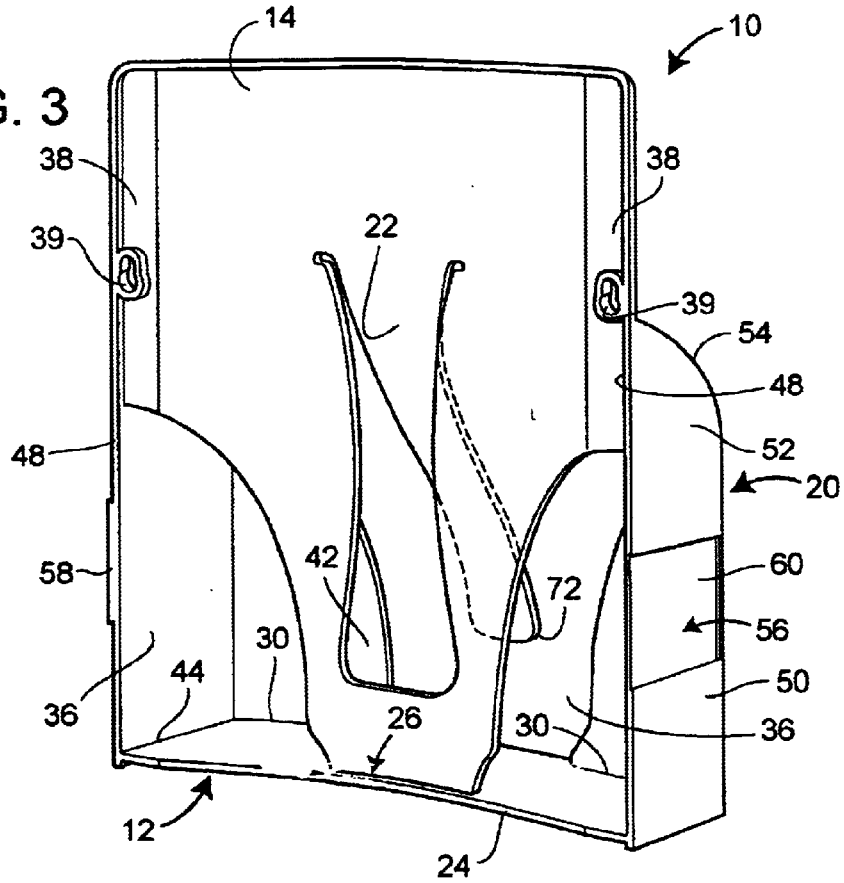
FIG. 3 is a rear perspective view of the brochure holder.

A spring member 22, integrally formed with the rear wall extends outward and downward from the rear wall. As illustrated in FIGS. 1 and 2, a rear edge 24 of base 12 is attached to the lower edge 26 of rear wall 14. The rear edge of 24 of base 12 has the same profile as the rear wall 14. Since the lower edge of rear wall 14 does not extend the entire width of the rear wall, the profile of the rear wall can be viewed from a top view as illustrated in FIG. 3.

Figure 5:
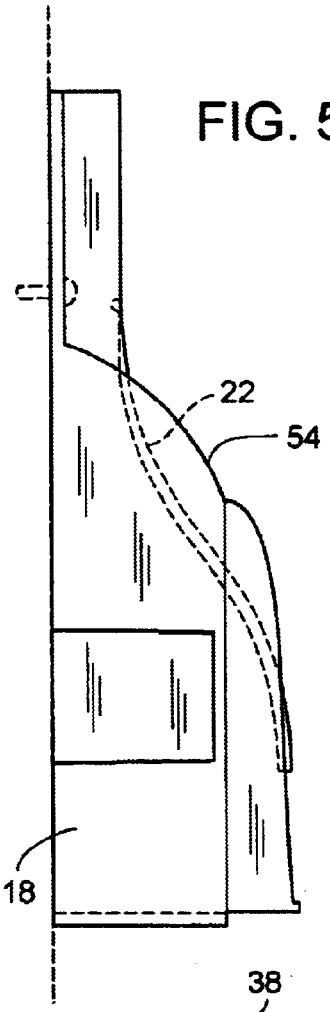
FIG. 5 is a plan view of the first side of the brochure holder.

Referring to FIG. 5, base 12 includes a convex front edge 28 as viewed from the front, that is attached to the lower edge 30 of front wall portions 16. In the preferred embodiment a substantial portion of the front edge 28 is curved and parallel with the back edge 24 of the base 12. Base 12 further includes a pair of substantially parallel side edges 32 connected to the side walls 18. The side walls may have a slight draw to facilitate manufacture. The base is a planar member.

Side walls 16, front wall portions 16 and rear wall 14 are substantially perpendicular to base 12. The side, front and rear walls may have a slight draw to facilitate manufacturing. In the preferred embodiment and as will be discussed further below base 12 is to be deployed horizontally. In this orientation, the lower edge of a brochure or paper will rest upon base 12, with rear edge 24 of base 12 being at the same height 28 as the front edge of the base.

As noted above, the lower edge of 26 of the rear wall is attached to the back edge 24 of the base 12 in a center region of the base. The rear wall extends from the center region of the base upward and outward toward the side walls 18. In this manner a pair of openings 36 are formed as outlined by the rear wall, base and side walls. (See FIG. 6).

Figure 6:
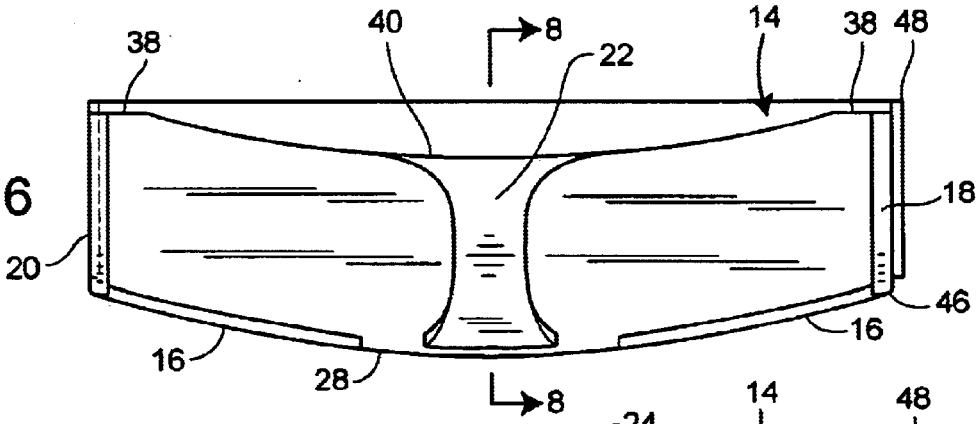
FIG. 6 is a top plan view of the brochure holder.

Rear wall 14 further includes a pair of attachment regions 38 proximate the each outer edge left and right edges of the rear wall. Attachment regions 38 are flat regions that will be located against a wall when the brochure holder is installed on a vertical wall surface. Attachment regions 38 are substantially perpendicular to side walls 18. Each attachment region 38 includes a fastening means to secure the brochure holder to a vertical structure. As illustrated in FIG. 6, each attachment region includes a tear drop shaped aperture 39 to receive a post or screw secured to a vertical surface. Similarly, fastening means 39 may include the post or any other type of mechanical fastener known in the art to secure a file holder, brochure holder, or shelf to a vertical surface such as a wall.

Rear wall 14 further includes a center curved region 40 that is concave as viewed from the rear, and convex as viewed from the front of the brochure holder. Similar to openings 36 to permit the integral manufacture of the front wall portions with the brochure holder 10, rear wall 14 further includes a center opening 42 that permits the integral formation of spring member 42.

Figure 4:
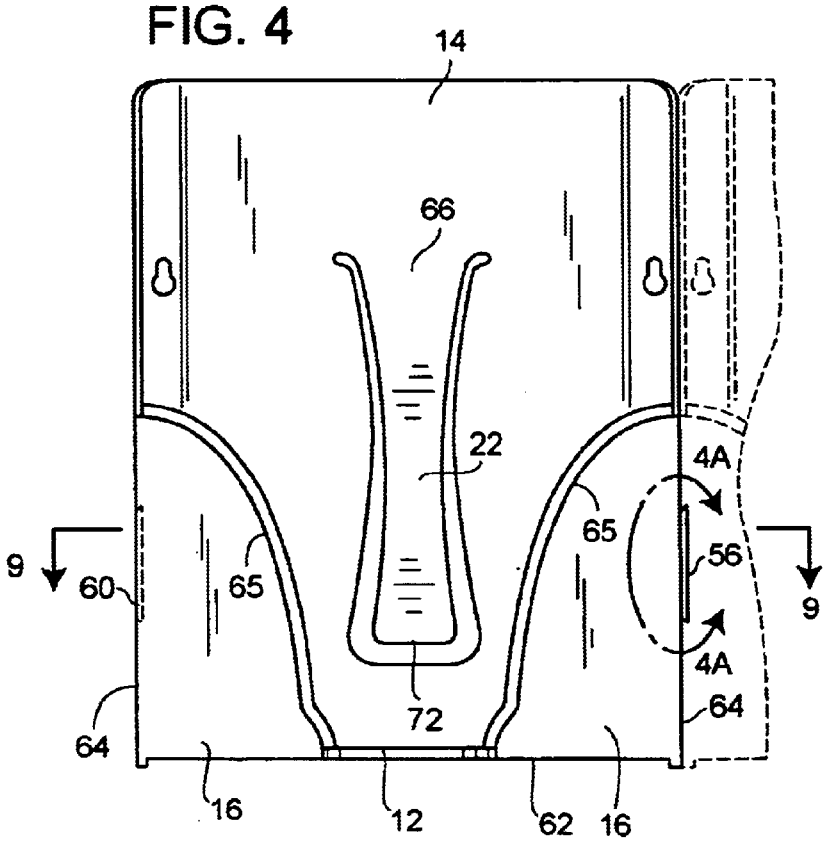
FIG. 4 is a front plan view of the brochure holder.
Figure 4A:
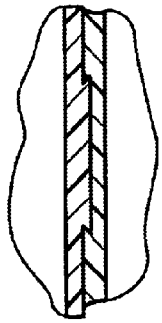
FIG. 4A is a cross-sectional view taken generally along lines 4A—4A is FIG. 4.

Referring to FIGS. 3 and 4, side walls 18, 20 include a lower edge 44 extending from the side edges of base 12. Extending downward from lower edge 44 is a leg member 45 that extends below base 12 to support the brochure holder 10 on a horizontal surface. Side walls 18 include a front edge 46 secured to a respective front wall portion 16, and a rear edge 48 having a lower portion 50 and an upper portion 52 secured to the rear wall 14. Rear wall 14 is attached to the side walls only at the upper portion 52. A top edge 54 extends from the front edge 46 upward and rearward toward the rear edge 48. The pair of side walls 18 include a fastening means 56 including a male 58 and female 60 portion, such as a mortise and tenon, located on the respective side walls 18. As will be described below the fastening means 56 permits a number of brochure holders 10 to be secured to one another in a side by side fashion.

Figure 7:
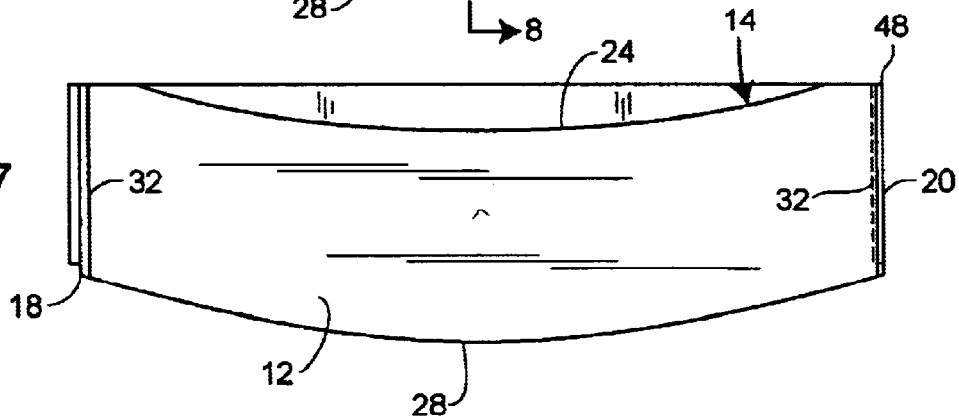
FIG. 7 is a bottom plan view of the brochure holder.

Referring to FIGS. 1 and 7, each front wall portion 16 includes a lower edge 62 secured to the front edge of base 12, and a side or outer edge 64 secured to the lower portion 50 of side wall 18. Each front wall portion 16 has a curved convex profile that is collinear with the front edge 28 of the base 12 and parallel with the profile of the rear wall as discussed above. Each front wall portion 16 includes an inner edge 65 that extends from the base to the side wall proximate the bottom of the upper portion 52. The space between the respective inner edges 65 of the two front wall portions 16 provides an opening, to view without obstruction, the center area of a brochure located in the holder 10.

Turning now to the integrally formed spring member 22 illustrated in FIG. 1., spring member 22 includes an upper edge 66 integrally formed and extending from the back wall 14. Spring member 22 has a first concave portion 68 as viewed from the front that extends downwardly and outwardly and a second convex portion 70 as viewed from the front of the holder that extends downwardly and outwardly and terminating in a free end 72. The horizontal distance between free end 72 and upper edge 66 is the same distance between the rear edge of the base and the front edge of the base in the center region of the base. However, the horizontal distance may be greater than or less than the width of the base depending on the thickness of each brochure to be stored and the resiliency of the spring material. Spring member 22 has a profile that is substantially parallel with opening 42 in rear wall 14, when the profiles are projected onto a vertical plane. However, the width of the spring member 22 at a given vertical distance from the base is less than the width of the opening 42.

The spring member functions to push the brochures toward the front wall portions 16 and also to impart a curve in the brochures to conform with the curved profile of the front wall portions. Since the spring member is centrally located, the force applied to the center region of the brochures will tend to both impart a curve in the brochures as well as to bias the brochures toward the front wall portions.

The operation of the brochure holder will now be discussed. The brochure holder 10 can either be supported by the base 12 resting on a horizontal support surface or can be supported on vertical surface by securing the brochure holder to the vertical surface with the attachment means 39 located on rear wall 40. In either mode of support, the brochure holder is oriented in an upright position with the base 12 horizontally disposed and the attachment region of the rear wall vertically disposed. In this position, the side walls are substantially vertical as well. A cavity 74 is defined by base 12, rear wall 14, side walls 18, 20 and front wall portions 16. A plurality of brochures or printed materials are placed into cavity 74 until the lower edge of the brochures rests on base 12. As the brochures are loaded into cavity 74 the brochures will contact the second convex portion 70 of spring 22 and flex spring 22 about its upper edge 66 toward opening 42 away from front wall portions 16. The flexure of spring 22 toward opening 42 results in a force being applied to the brochures toward the front wall portions 16. Since the front wall portions are curved, and the spring force is applied to the center portion of the brochures, the brochures will have a tendency to curve to conform to the profile of the front wall portions 16. This curvature of the brochures provides additional vertical stability to the brochures to ensure that flexible materials remain in a vertical upright position. In the preferred embodiment the distance along the arc of the front wall portions between the side walls is greater than the width of the printed materials to ensure the side edges of the brochures do hot rub against the side walls. This minimizes any damage to the side edges of the brochures, and makes removal of the brochures easier for a user, since there is no frictional resistance along the edges of the brochure. As each brochure is taken from holder 10 spring 22 biases the remaining brochures against the front wall portions until the last brochure is pressed against the front wall portions.

Spring member 22 is designed to provide sufficient spring force to both impart curvature to and force even a single sheet of paper against the front walls of the holder.

The vertical height of the front wall portions 16 along its outer edge 64 extending from the base is designed to be greater than one-half of the height of the brochure to be displayed in the holder 10. In the preferred embodiment, the brochure holder is configured to display brochures measuring eight and one-half by eleven inches. Accordingly, the height of the outer edge 64 of the front wall portions 16 is greater than five and one half inches. This adds to the stability of the brochure in the display case. Of course it is possible for the height of the front wall portions to be less than one-half of the height of the brochure to be displayed.

In the preferred embodiment, brochure holder is injected molded with a clear plastic material such as polycarbonate, general purpose polystyrene, high impact polystyrene, ABS, SAN, K-resin or acrylic. But other types of material may also be used. For example, the plastic need not be translucent but may be tinted or provided with a color hue.

While several preferred embodiments have been shown and described it is understood that changes and modifications can be made to the invention without departing from the invention's broader aspects. For example, other materials such as wood, metal or any other type of material in which an integral spring member may be formed can also be employed to manufacture the brochure holder. Thus it is apparent that alternative embodiments are available to those skilled in the relevant art.

What is claimed is:

1. A brochure holder, comprising:

a base;

a convexly curved front wall having a center region, the convexly curved front wall fixed to and extending from the base, and being convexly curved relative to a spring;

a rear wall extending from the base; and the spring extending from the rear wall toward the center region of the front wall.

2. A brochure holder, comprising:

a base;

a curved front wall having a center region, the curved front wall extending from the base;

a rear wall extending from the base;

a spring extending from the rear wall toward the center region of the front wall; and a pair of side walls extending from the base and attached to the rear wall and front wall.

3. The brochure holder of claim 2, wherein each side wall includes an upper portion attached to the rear wall only, and a lower portion attached to the front wall only.

4. The brochure holder of claim 3, wherein the brochure holder is a single injection molded component.

5. The brochure holder of claim 2, wherein the front wall includes a first portion attached to one of the pair of walls, and a second portion attached to the other of the pair of walls, the first and second front wall portions having a space therebetween.

6. The brochure holder of claim 4, wherein the rear wall includes a first opening having a predetermined width and an upper edge, the spring extending from the upper edge and having a width less than the predetermined width of the first opening.

7. The apparatus of claim 6, wherein the rear wall includes a pair of second openings, each second opening having a width that is less than a width of the first and second front wall portions respectively when measured from a corresponding height from the base.

8. The apparatus of claim 2, wherein the rear wall includes a pair of side edges and an attachment region proximate each of the side edges, each of the side edges being coplanar.

9. The apparatus of claim 2, wherein the rear wall includes a curved center portion intermediate the side edges.

10. The apparatus of claim 2, wherein the spring extends from the center region of the rear wall.

11. A method for supporting a stack of flexible material in a holder, comprising:

supporting the stack of flexible material along a base of the holder;

biasing the stack of flexible material against a convexly curved front wall portion with a spring, wherein the front wall portion is convexly curved relative to the spring, and wherein the front wall portion is fixed to and extends from the base; and imparting a convex curvature to the flexible material.

12. The method of claim 11, wherein supporting the stack of flexible material includes supporting the stack of material on a horizontal base.

13. The method of claim 12, wherein the stack of flexible material includes a front portion and a rear portion, the front portion being located adjacent the front wall portion and the rear portion of the stack of flexible material being in contact with the spring.

14. The method of claim 13, wherein biasing the stack of flexible material includes biasing the center of the rear portion of the flexible stack of material to impart a curvature to the stack of flexible material.

15. A display holder for flexible sheet material comprising:

a horizontal base;

a rear wall extending from the horizontal base and including a first center opening having a top edge;

a spring extending from the top edge and having a width less than the width of the center opening;

a pair of side walls extending from the base and including a lower portion and an upper portion, the upper portion being attached to the rear wall, the rear wall and lower portions of the side walls defining a pair of second openings having a predetermined width; and a pair of front wall portions, each front wall portion extending from the base and from a respective side wall, each front wall portion having a width less than the width the respective second opening, the width of the front wall portions and second openings being measured from a corresponding height from the base.

16. The display holder of claim 15, wherein the display is one piece.

17. The display holder of claim 16, wherein the front wall front wall portions are curved.

18. The display holder of claim 17, wherein the width of the spring is less than the distance between the front wall portions.

19. The display holder of claim 18, wherein the rear wall includes a center portion including the center opening, the rear wall including a planar attachment region to secure the display holder to a vertical surface.

20. The display holder of claim 19, wherein the spring is located between the front wall portions.

* * * * *

UNITED STATES PATENT AND TRADEMARK OFFICE

CERTIFICATE OF CORRECTION

PATENT NO. : 6,651,827 B1 
DATED : November 25, 2003
INVENTOR(S) : Brian T. Eberwein et al.

It is certified that error appears in the above-identified patent and that said Letters Patent is hereby corrected as shown below:

Column 5,
Line 41, please delete "pair of walls," and insert -- pair of side walls, --.
Lines 42-43, please delete "pair of walls," and insert -- pair of side walls, --.

Signed and Sealed this

Third Day of February, 2004

JON W. DUDAS
*Acting Director of the United States Patent and Trademark Office*